US006056412A

United States Patent [19]

Atlee et al.

[11] Patent Number: 6,056,412

[45] Date of Patent: May 2, 2000

[54] WAIST MOUNTED ILLUMINATING DEVICE

[76] Inventors: Elizabeth Eckhardt Atlee; Steven David Atlee, both of 11965 Gorham Ave., Unit 403, Los Angeles, Calif. 90049

[21] Appl. No.: 08/975,581

[22] Filed: Nov. 21, 1997

[51] Int. Cl.[7] ..... F21L 15/08

[52] U.S. Cl. ..... 362/103; 362/108; 362/200; 362/186; 362/257; 362/311; 224/660; 224/919

[58] Field of Search ..... 362/103, 108, 362/200, 186, 257, 311; 224/660, 919

[56] References Cited

U.S. PATENT DOCUMENTS

| | | | |
|---|---|---|---|
| D. 293,387 | 12/1987 | Wagner, II . | |
| 3,840,853 | 10/1974 | Cukale . | |
| 3,852,587 | 12/1974 | Koehler . | |
| 3,906,216 | 9/1975 | Eriksson . | |
| 3,912,919 | 10/1975 | Eriksson . | |
| 4,112,482 | 9/1978 | Powell . | |
| 4,249,233 | 2/1981 | Gatton . | |
| 4,298,913 | 11/1981 | Lozar . | |
| 4,337,759 | 7/1982 | Popovich et al. . | |
| 4,514,791 | 4/1985 | Tokieda . | |
| 4,631,644 | 12/1986 | Dannhauer . | |
| 4,849,863 | 7/1989 | Gallegos | 362/108 |
| 4,991,068 | 2/1991 | Mickey . | |
| 5,115,382 | 5/1992 | Smith . | |
| 5,358,461 | 10/1994 | Bailey . | |
| 5,411,461 | 5/1995 | Thomascik . | |
| 5,434,759 | 7/1995 | Endo | 362/108 |

*Primary Examiner*—Stephen Husar
*Assistant Examiner*—Ronald E. Delgizzi
*Attorney, Agent, or Firm*—David W. Victor; Konrad Raynes & Victor LLP

[57] ABSTRACT

Disclosed is a waist mounted illuminating device comprised of a belt having a length sufficient to fit around a person's waist. A compartment comprised of flexible material is located on the belt. The compartment has an opening. A battery operated light having an illuminable face is disposed in the compartment and directs light through the opening in the compartment. The compartment and belt may be formed of a flexible material such as neoprene. When the belt is firmly adjusted around a user's waist, the compartment and belt firmly and steadily maintain the battery operated light on the user's waist, even while the user is running or jogging. This stable mount of the light to the waist provides steady illumination of the user's path for general illumination and for exercise activities such as running or jogging.

25 Claims, 5 Drawing Sheets

WAIST MOUNTED ILLUMINATING DEVICE

BACKGROUND OF THE INVENTION

1. Field of the Invention

The present invention relates to an illuminating device worn around a person's waist and, in preferred embodiments, a waist mounted illuminating device which remains steady and in place during rapid movement such as running or jogging.

2. Description of Related Art

Prior art illuminating devices include battery operated lights mounted on a person's head or waist which illuminate a limited area. Prior art head mounted battery operated lights are particularly suited for locating items in the dark or illuminating a path while walking. However, such headband lights are not suitable for steadily illuminating a path while the person wearing the head mounted flash light is running or moving rapidly. When a person runs or jogs, the head moves too much to provide a stable mount to steadily illuminate the path in front of the wearer.

Prior art illuminating devices worn around the waist suffer from similar defects. Certain prior art safety lights, such as the light disclosed in U.S. Pat. No. 4,112,482, entitled "Night Light Belt," may be suitable for alerting others of the presence of the person wearing the safety belt, but are often not suitable for steadily illuminating the wearer's path during significant movement. Moreover, prior art waist mounted lights often involve cumbersome and complicated structures to position the light around the waist, such as the waist mounted light disclosed in U.S. Pat. No. 5,358,461, entitled "Exerciser Activated Body Mounted Lights and Generators," which would also not prove sufficient to steadily illuminating a path during rapid movement or other similar physical activities.

SUMMARY OF THE PREFERRED EMBODIMENTS

To address the shortcomings in the prior art noted above, a preferred embodiment of a waist mounted illuminating device is disclosed. The waist mounted illuminating device is comprised of a belt having a length sufficient to fit around a person's waist. A compartment comprised of flexible material and having an opening is located on the belt. Disposed within the compartment is a battery operated light that has an illuminable face which directs light through the opening in the compartment.

In further embodiments, the compartment and belt are comprised of an elastic material such as neoprene. In alternative embodiments, the compartment and belt may be formed of different materials.

It is an object of the present invention to provide an improved device and structure for mounting an illuminating device to the waist of a person.

It is a further object to firmly mount the illuminating device to the waist such that the mounted light will steadily illuminate the path of the user even when the user is running, jogging or moving rapidly.

BRIEF DESCRIPTION OF THE FIGURES

Referring now to the drawings in which like reference numbers represent corresponding parts throughout.

DETAILED DESCRIPTION OF THE PREFERRED EMBODIMENTS

Figure 1:
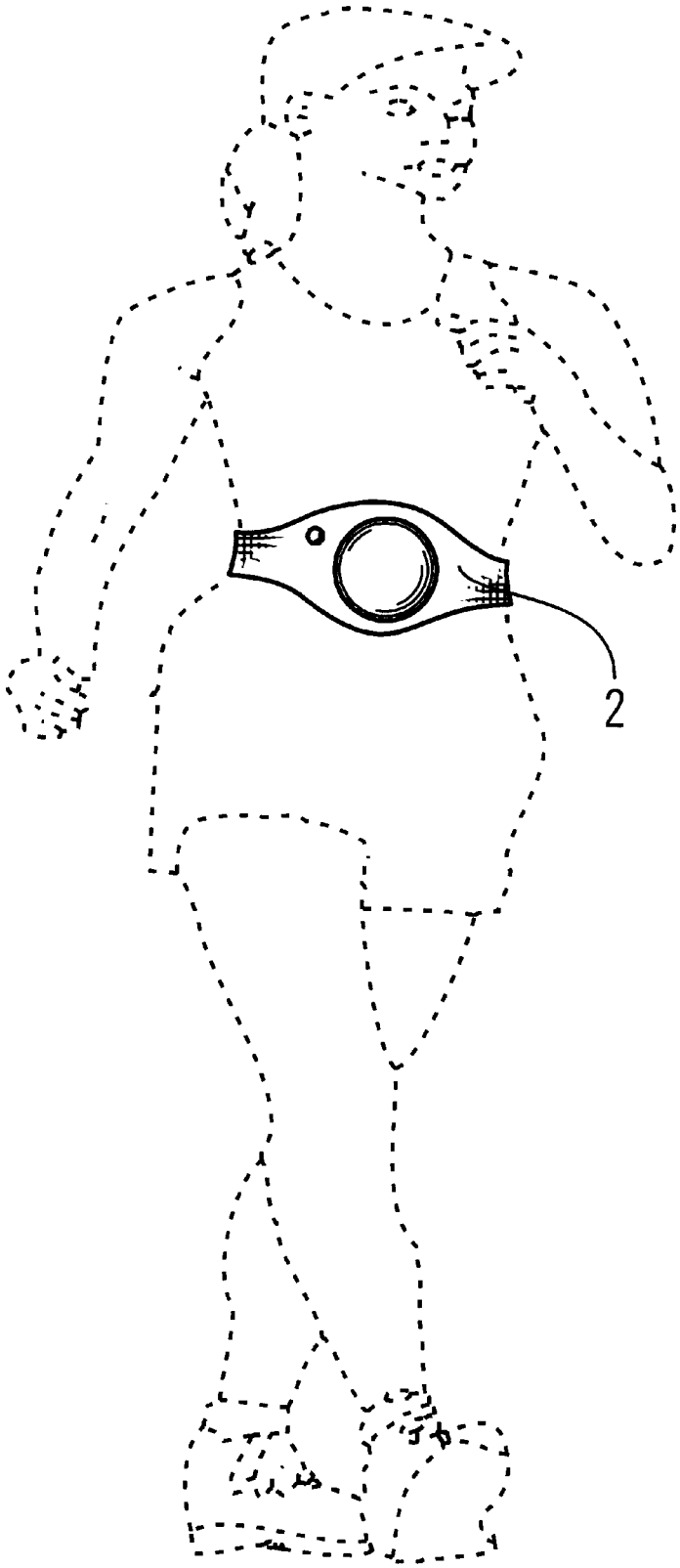
FIG. 1 is an illustration of a perspective view of a preferred embodiment of a waist mounted illuminating device in accordance with the present invention.

Preferred embodiments of the waist mounted illuminating device of the present invention are described with reference to FIGS. 1–10. In the detailed description below, references made to the "front," "back," "rear," "side," "right," "left," "center," "top," "bottom," "vertical" or "horizontal" portions of the waist mounted illuminating device and elements thereof are made with reference to the orientation of the structures shown in the drawings and are not intended to limit the scope of the invention where such limitations are otherwise not required.

FIG. 1 illustrates how a waist mounted illuminating device 2 in accordance with the present invention is worn around a person's waist.

Figure 2:
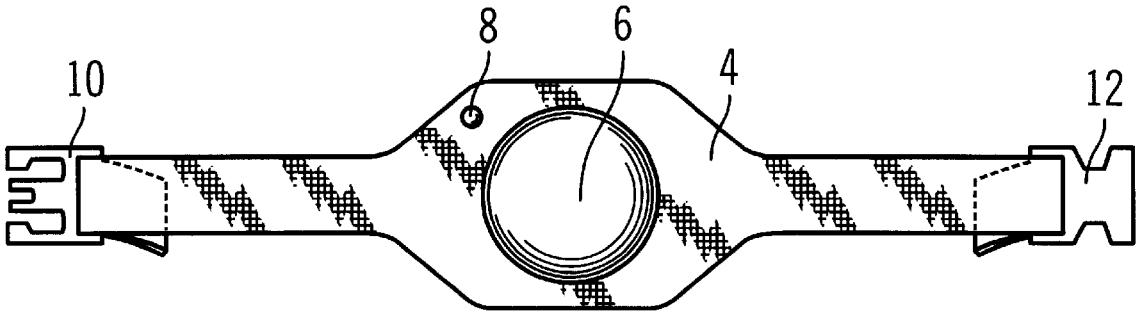
FIG. 2 is an illustration of a front view of a preferred embodiment of a waist mounted illuminating device in accordance with the present invention.
Figure 3:
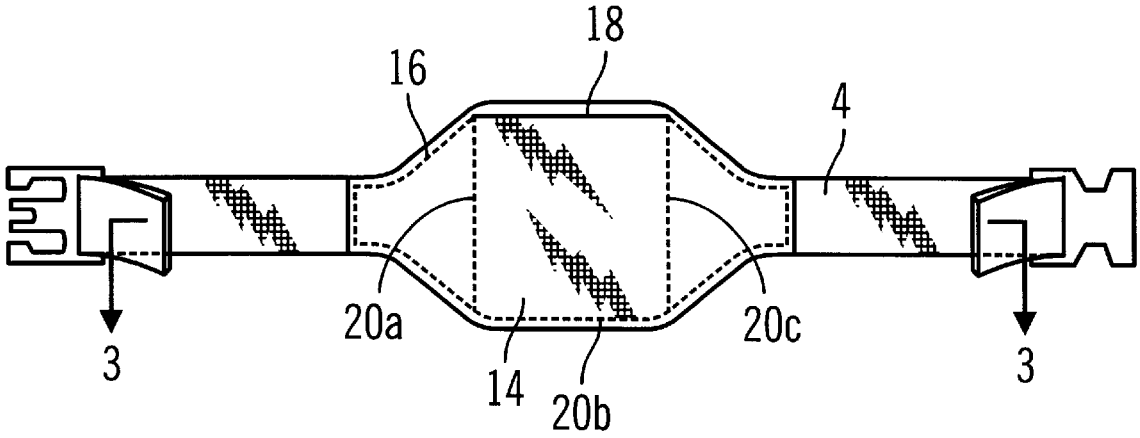
FIG. 3 is an illustration of a rear view of a preferred embodiment of the waist mounted illuminating device shown in FIG. 2.
Figure 4:
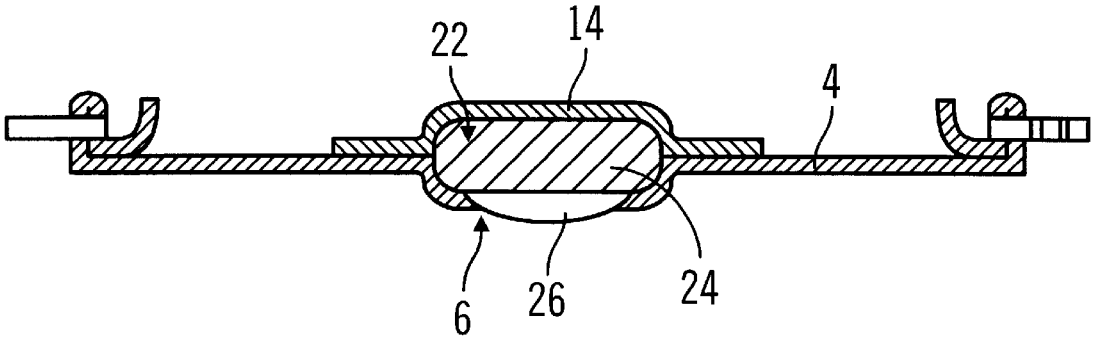
FIG. 4 is an illustration of a horizontal cross sectional view of a preferred embodiment of a waist mounted illuminating device taken along the line of 3—3 in FIG. 3.

FIGS. 2–4 illustrate a first set of preferred embodiments of the waist mounted illuminating device in accordance with the present invention. FIG. 2 shows a belt 4 having circular openings 6 and 8. The ends of the belt 4 are looped through a male buckle 10 and a female buckle 12. The length of the belt 4 extending around the waist may be adjusted by increasing or decreasing the length of the ends looped through the male 10 and/or female 12 buckles. Alternative buckles and fastener means known in the art may be used to secure and adjust the belt 4 around the waist of the user.

FIG. 3 illustrates a preferred embodiment of the backside of the belt 4 which rests against the waist of the user. A piece of flexible material 14 is attached to the backside of the belt 4 and covers the opening 6 (FIG. 2). In the preferred embodiment of FIG. 3, the flexible material 14 is attached to the belt 4 by stitching the flexible material 14 to the belt 4 along the stitched line 16. The stitching pattern 16 leaves top side 18 of the flexible material 14 free with respect to the belt 4. A compartment 22 (shown in FIG. 4) is formed between stitched lines 20*a*, 20*b*, 20*c*, the flexible material 14, and the belt 4.

FIG. 4 illustrates a cross-sectional view of the belt 4 taken along the horizontal line 3—3 in FIG. 3. The compartment 22 contains a battery operated light 24. The battery operated light 24 has an illuminable face 26 which extends across the opening 6 in the belt 4, and has a lens which is particularly suited to radiate light through the opening 6.

With reference to FIGS. 3 and 4, the battery operated light 24 may be placed in the compartment 22 (FIG. 4) through the side 18 (FIG. 3) of the flexible material 14 that remains free with respect to the belt. A material, such as Velcro®, may be placed along the inside surface of the side 18 of the flexible material 14 and along a portion of the belt 4 to close the opening into the compartment 22 through side 18 once the battery operated light 24 is disposed within the compartment 22. In alternative embodiments, other mechanisms known in the art may be used to temporarily close the side 18 to the belt 4.

When properly positioned in the compartment 22, the illuminable face 26 of the light 24 extends across the opening 6 in the belt 4 and an on/off button (not shown) of the light 24 extends through the opening 8 (FIG. 2) in the belt 4. In further embodiments, other control switches to control the operation of the battery operated light 24, such as a light intensity controller, may extend through the compartment 22. The openings 6 and 8 are positioned with respect to each other such that the battery operated light 24 is properly positioned within the compartment 22 when the illuminable face 26 and on/off button are positioned through openings 6, 8, respectively. In this way, the user may properly position the battery operated light 24 within the compartment 22 by guiding the on/off button through opening 8.

Figure 5:
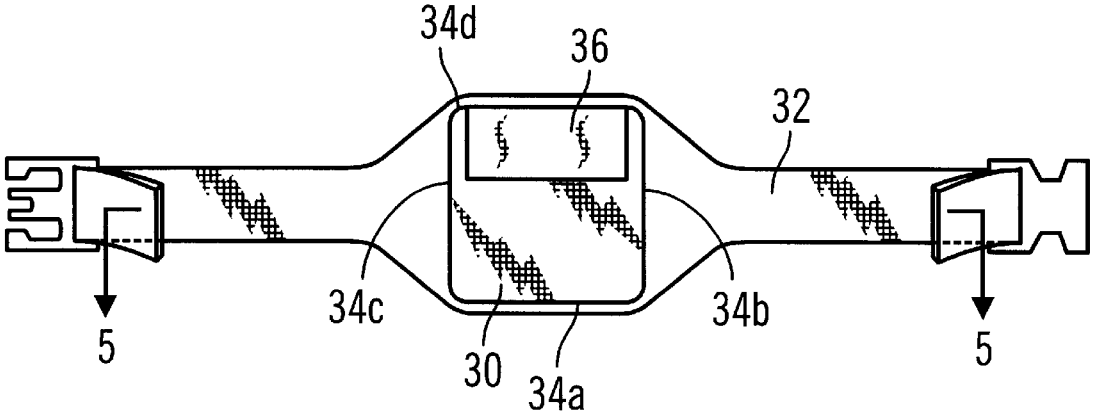
FIG. 5 is an illustration of a rear view of a preferred embodiment of a waist mounted illuminating device in accordance with the present invention.

FIG. 5 illustrates a second set of preferred embodiments of the waist mounted illuminating device. A material 30 is attached to belt 32 along sides 34*a*, 34*b*, 34*c*. The material 30 may be attached to the belt 32 by stitching or other suitable attachment means known in the art. A side 34*d* of the material 30 is left free with respect to the belt 32. A separate piece of material forming a flap 36, shown in the closed position in FIG. 5, may be lifted to insert a battery operated light.

Figure 6:
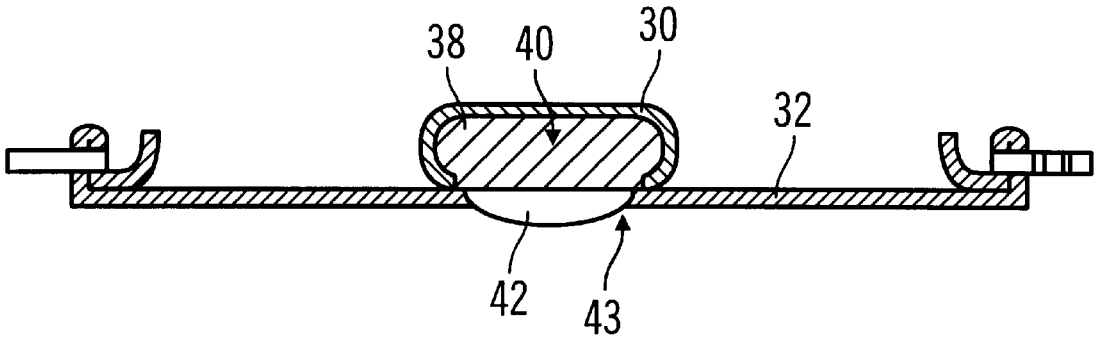
FIG. 6 is an illustration of a horizontal cross sectional view of a preferred embodiment of a waist mounted illuminating device taken along the line 5—5 in FIG. 5.

FIG. 6 illustrates a horizontal cross-sectional view of the waist mounted belt of FIG. 5 taken along the line 5—5 in FIG. 5. FIG. 6 shows a battery operated light 38 disposed within a compartment 40 formed between the material 30 and belt 32. An illuminable face 42 of the battery operated light 38 extends across an opening 43 in the belt 32.

Figure 7:
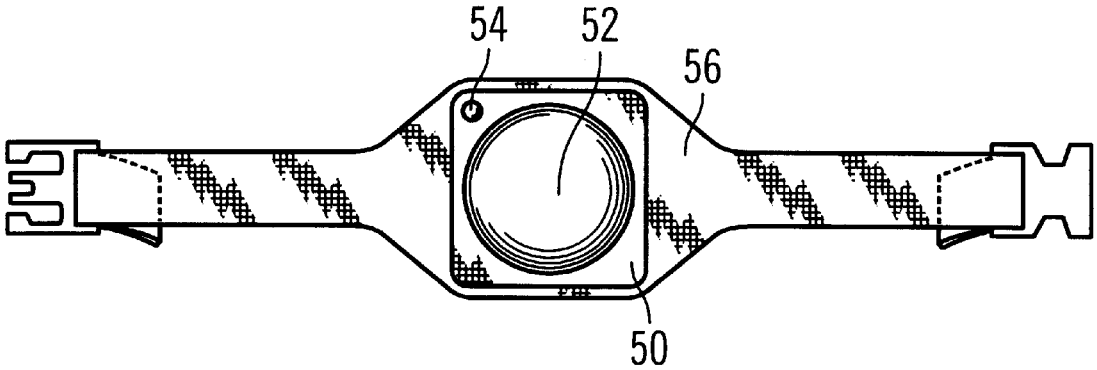
FIG. 7 is an illustration of a front view of a preferred embodiment of a waist mounted illuminating device in accordance with the present invention.
Figure 8:
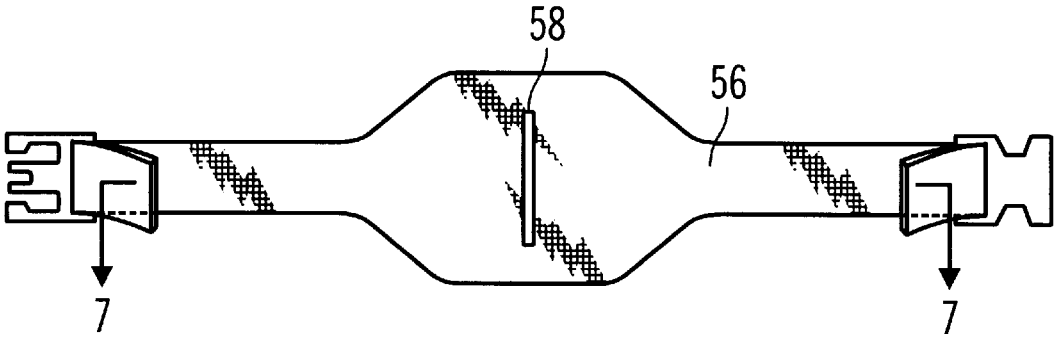
FIG. 8 is an illustration of a rear view of a preferred embodiment of the waist mounted illuminating device shown in FIG. 7.
Figure 9:
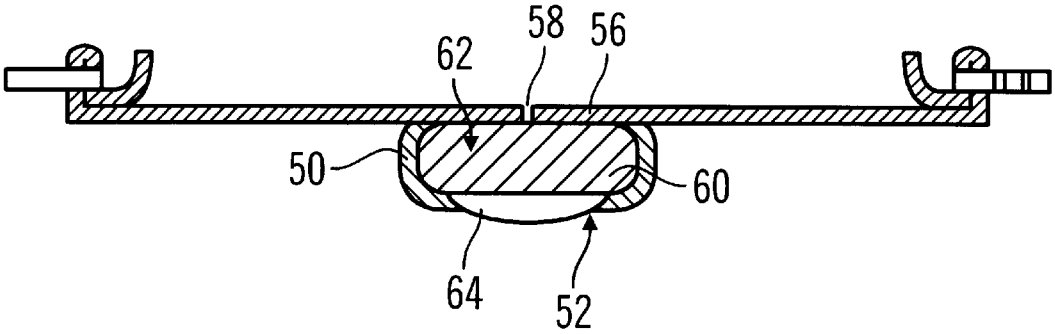
FIG. 9 is an illustration of a horizontal cross sectional view of a preferred embodiment of a waist mounted illuminating device taken along the line 7—7 in FIG. 8.

FIG. 7–9 illustrate a third set of preferred embodiments in accordance with the present invention. FIG. 7 illustrates a piece of flexible material 50 that has two openings 52 and 54. The flexible material 50 is attached to belt 56. FIG. 8 illustrates the rear view of the belt 56 of FIG. 7, and shows a slit 58 vertically extending along a portion of the belt 56.

FIG. 9 illustrates a horizontal cross-sectional view of the embodiments of FIGS. 7 and 8 taken along the line 7—7 in FIG. 8. A battery operated light 60 is disposed in a compartment 62 formed between the belt 56 and flexible material 50 attached thereto. An illuminable face 64 of the battery operated light 60 extends through the opening 52 in the flexible material 50. The battery operated light 60 may be inserted and removed from the compartment 62 through the slit 58. Velcro® may be positioned around the edges of the slit 58 to temporarily close the slit 58 once the battery operated light 60 is positioned in the compartment 62. An on/off button or other control mechanism (not shown) on the battery operated light 60 extends through the opening 54.

Figure 10:
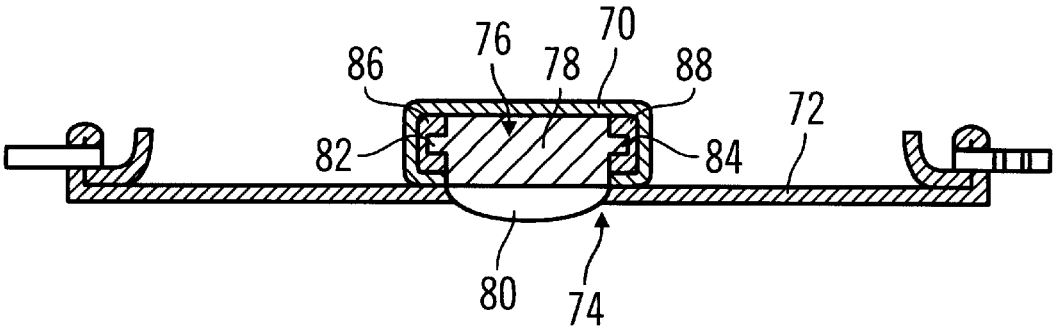
FIG. 10 is an illustration of a horizontal cross sectional view of a preferred embodiment of a waist mounted illuminating device in accordance with the present invention.

FIG. 10 shows a horizontal cross-section of a fourth set of preferred embodiments in accordance with the present invention. A piece of flexible material 70 is attached to belt 72. The belt 72 has an opening 74. A compartment 76 is formed between the belt 72 and flexible material 70. The opening 74 opens into the compartment 76. A battery operated light 78 has an illuminable face 80 which extends across the opening 74. The battery operated light 78 has two flanges 82, 84 that extend along opposite sides of the battery operated light 78.

The mounting structure for the battery operated light 80 is comprised of vertical supports 86 and 88 affixed to opposite sides of the compartment 76 that extend vertically therethrough with respect to the horizontal position of the belt 70 when secured around the user's waist. In the embodiment of FIG. 10, the flanges 82, 84 of the battery operated light 78 are slidably mounted into the vertical supports 86, 88, respectively. In this way, the vertical supports 86, 88 mated with the flanges 82, 84 provide a stable mount for the battery operated light 78 and, hence, a steady path of illumination even if the user is running or moving rapidly.

In alternative embodiments, the support members 86, 88 may be horizontally oriented with respect to the belt 72. In such case, the battery operated light 78 would be slidably mounted along the horizontal axis of the belt 72 as opposed to the vertical orientation illustrated in FIG. 10.

In all the preferred embodiments shown in FIGS. 2–10, both the flexible material (14, 30, 50, 70) and belt (4, 32, 56, 72) are formed of an elastic material, such as neoprene. When the belt is adjusted to firmly fit around the waist of the user, the neoprene belt and attached flexible material stretch around the battery operated light (24, 38, 60, 78). The combination of, one, the stretch fit of the neoprene belt and attached flexible material around the battery operated light and, two, the belt around the waist of the user, steadily mounts the battery operated light around the wearer's waist. Moreover, in the first, second, and fourth embodiments, the battery operated light (24, 38, 78) is further maintained against the user's body by being positioned between the belt (4, 32, 72) and the user's waist body, whereby the belt further forces the battery operated light against the body. During rapid movement, such as running or jogging, a person's waist remains relatively stable with respect to the rest of the body. Thus, the stable mount of the battery operated light to the user's waist provided by the preferred embodiments permits a steady illumination of the user's path during rapid movement such as running or jogging. Moreover, the present invention is equally well suited to generally illuminate a person's path for purposes such as hiking, walking or providing a safety light.

Those skilled in the art will appreciate that the belt (4, 32, 56, 72) and flexible material (14, 30, 50, 70) may be formed of flexible or elastic materials other than neoprene. Moreover, the belt and flexible material may be comprised of different materials. For instance, the belt may be comprised of a canvas or leather material, while the flexible material is comprised of a sufficiently flexible and elastic material such that the flexible material will stretch around the battery operated light to maintain it in place within the compartment. Notwithstanding, neoprene includes desirable elastic properties which render neoprene especially suited for use in preferred embodiments of the present invention. In further embodiments, different shapes and dimensions for the opening (6, 43, 52, 74) in the belt and shape of the illuminable face (26, 42, 64, 80) of the light may be used.

In all the preferred embodiments shown in FIGS. 2–10, the Illuminable face (26, 42, 64, 80) of the battery operated light (24, 38, 60, 78) is comprised of a lens suitable for radiating light. Such radiating lenses are well known in the art, such as the lens disclosed in U.S. Pat. No. 4,337,759, entitled "Radiant Energy Concentration By Optical Total Internal Reflection," which is incorporated herein by reference in its entirety. In preferred embodiments the Hi-Gain battery operated light sold by Diamond Light Industries may be used for the battery operated light (24, 38, 60, 78). However, it should be appreciated that alternative battery operated lights having different shaped illuminable faces and lenses, and different illumination intensities may be used to illuminate the path of the wearer or, alternatively, serve as a safety light observable by others.

In all the above embodiments, the battery operated light is maintained within a compartment. However, in alternative embodiments the battery operated light may be attached directly to the belt in a manner such that the battery operated light is positioned between the belt and the wearer's waist when the belt is worn around the waist. In such an embodiment, the illuminable face of the battery operated light extends through an opening in the belt in the manner discussed above. The battery operated light may be permanently attached to the belt by stitching, gluing or other suitable means. Alternatively, the battery operated light may be removably mounted to the belt using Velcro™ or a mounting structure to slidably mount the battery operated light into a mounting structure attached to the belt, such as the mounting structure described with respect to FIG. 10. In this embodiment, the belt, formed of an elastic material, maintains the battery operated light firmly against the waist of the user to provide a steady illumination of the wearer's path during rapid movement such as running or jogging.

The foregoing description of the preferred embodiments have been presented for the purpose of illustration and description. It is not intended to be exhaustive or to limit the invention to the precise form disclosed. Many modifications and variations are possible in light of the above teachings. It is intended that the scope of the invention be limited not by this detailed description, but rather, by the claims appended hereto.

What is claimed is:

1. A waist mounted illuminating device, comprising:

a belt having a length sufficient to fit around a person's waist;

a compartment comprised of elastic material located on the belt;

an opening in the compartment;

a battery operated light having an illuminable face disposed in the compartment, wherein the illuminable face directs light through the opening in the compartment at an intensity sufficient to illuminate a path in front of the person wearing the belt.

2. The waist mounted illuminating device of claim 1, wherein the illuminable face extends across the opening in the compartment.

3. The waist mounted illuminating device of claim 1, wherein the elastic material is neoprene.

4. The waist mounted illuminating device of claim 1, wherein the belt and compartment are comprised of elastic material.

5. The waist mounted illuminating device of claim 4, wherein the elastic material is neoprene.

6. The waist mounted illuminating device of claim 1, wherein the compartment has a first portion and a second portion, wherein the first portion is comprised of a portion of the belt and the second portion is comprised of a piece of flexible material attached to the belt.

7. The waist mounted illuminating device of claim 6, wherein the opening through which the light is directed is in the second portion of the compartment.

8. The waist mounted illuminating device of claim 1, further including an additional opening in the compartment of sufficient size to receive the battery operated light.

9. The waist mounted illuminating device of claim 1, further including:

a second opening in the compartment; and a control button of the battery operated light that extends through the second opening, wherein the control button controls an operation of the battery operated light.

10. The waist mounted illuminating device of claim 1, wherein the battery operated light is disposed within the compartment and the illuminable face is flush with the opening.

11. The waist mounted illuminating device of claim 1, wherein a width of the opening comprises a substantial portion of a width of a portion of the belt adjacent to the illuminable face.

12. A waist mounted illuminating device, comprising:

a belt having a length sufficient to fit around a person's waist;

a compartment comprised of elastic material located on the belt;

an opening in the compartment, wherein the compartment has a first portion and a second portion, wherein the first portion is comprised of a portion of the belt and the second portion is comprised of a piece of flexible material attached to the belt;

a battery operated light having an illuminable face disposed in the compartment, wherein the illuminable face directs light through the opening in the compartment, wherein the opening through which the light is directed is in the first portion of the compartment.

13. A waist mounted illuminating device, comprising:

a belt having a length sufficient to fit around a person's waist;

a compartment comprised of elastic material located on the belt;

an opening in the compartment;

a battery operated light having an illuminable face disposed in the compartment wherein the illuminable face directs light through the opening in the compartment first and second support members disposed within the compartment, wherein each support member has a slot extending therethrough; and wherein the battery operated light has a first side and a second side, wherein a portion of the first side of the battery operated light is slidably mounted in the slot in the first support member and the second side of the battery operated light is slidably mounted in the slot in the second support member, and wherein the illuminable face directs light through the opening in the compartment when mounted in the support members.

14. The waist mounted illuminating device of claim 13, wherein the support members extend along the vertical length of the compartment and wherein the support members are on opposite sides of the compartment.

15. A waist mounted illuminating device, comprising:

a belt of sufficient length to fit around a person's waist;

an opening in the belt;

a piece of flexible material attached to the belt, wherein the flexible material extends across the opening in the belt; and a battery operated light having an illuminable face disposed between the flexible material and the belt, wherein the illuminable face directs light through the opening in the belt.

16. The waist mounted illuminating device of claim 15, wherein the flexible material is comprised of neoprene.

17. The waist mounted illuminating device of claim 15, wherein a portion of the flexible material remains free with respect to the belt.

18. The waist mounted illuminating device of claim 15, wherein a movable flap extends over the portion of the flexible material which remains free with respect to the belt.

19. The waist mounted illuminating device of claim 15, wherein the battery operated light is disposed within the compartment and the illuminable face is flush with the opening.

20. The waist mounted illuminating device of claim 15, wherein a width of the opening comprises a substantial portion of a width of a portion of the belt adjacent to the illuminable face.

21. A waist mounted illuminating device, comprising:

a belt comprised of elastic material having a length sufficient to fit around a person's waist;

an opening in the belt;

a battery operated light having an illuminable face attached to the belt adjacent to the opening, wherein the illuminable face directs light through the opening in the belt when the belt is positioned around the waist of the person at an intensity sufficient to illuminate a path in front of the person wearing the belt.

22. The waist mounted illuminating device of claim 21, wherein the battery operated light is removably attached to the belt.

23. The waist mounted illuminating device of claim 21, wherein the battery operated light is disposed within the compartment and the illuminable face is flush with the opening.

24. The waist mounted illuminating device of claim 21, wherein a width of the opening comprises a substantial portion of a width of a portion of the belt adjacent to the illuminable face.

25. A waist mounted illuminating device, comprising:

a belt comprised of elastic material having a length sufficient to fit around a person's waist;

an opening in the belt;

a battery operated light having an illuminable face attached to the belt adjacent to the opening, wherein the illuminable face directs light through the opening in the belt when the belt is positioned around the waist of the person;

first and second support members affixed to the belt adjacent to the opening, wherein each support member has a slot extending therethrough; and wherein the battery operated light has a first side and a second side, wherein a portion of the first side of the battery operated light is slidably mounted in the slot in the first support member and the second side of the battery operated light is slidably mounted in the slot in the second support member, and wherein the illuminable face directs light through the opening in the belt when mounted in the support members.

* * * * *